US007845199B2

(12) United States Patent
Michalik

(10) Patent No.: US 7,845,199 B2
(45) Date of Patent: Dec. 7, 2010

(54) HEATING ELEMENT RETAINER

(75) Inventor: Gregor Michalik, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 386 days.

(21) Appl. No.: 12/009,854

(22) Filed: Jan. 22, 2008

(65) Prior Publication Data

US 2009/0183530 A1 Jul. 23, 2009

(51) Int. Cl.
*D06F 35/00* (2006.01)

(52) U.S. Cl. ..... 68/15

(58) Field of Classification Search ..... 68/15
See application file for complete search history.

(56) References Cited

U.S. PATENT DOCUMENTS 2,565,443 A * 8/1951 Vogel et al. ..... 219/454.12

2006/0101587 A1* 5/2006 Hong ..... 8/149.1

FOREIGN PATENT DOCUMENTS

GB 2080343 * 2/1982

* cited by examiner

*Primary Examiner*—Michael Cleveland
*Assistant Examiner*—Samuel A Waldbaum
(74) *Attorney, Agent, or Firm*—James E. Howard; Andre Pallapies

(57) ABSTRACT

A washer is provided. The washer includes a housing, a tub in the housing, a laundry drum rotatably mounted in the tub, a heating element in the tub, and a heating element retainer, on an inner surface of the tub, for retaining the heating element. The heating element retainer includes a first longitudinal end and a second longitudinal end. The heating element further includes an engaging portion that is formed closer to the second longitudinal end than to the first longitudinal end, and that retains a first end of the heating element.

24 Claims, 16 Drawing Sheets

HEATING ELEMENT RETAINER

FIELD OF DISCLOSURE

The present invention relates to a washer, and more particularly, to a washer having a heating element retainer.

BACKGROUND

FIG. 1 illustrates a conventional washer 2 having a tub 6 and a rotatable drum 4 in the tub 6. FIG. 2 illustrates a side view of an assembly of the tub 6 and drum 4.

The tub 6 may have an opening that permits a heating element (not shown) to penetrate a wall of the tub 6 of the washer 2. A base of the heating element typically may be hermetically sealed in the cavity, which is formed in the tub 6 of the washer 2. A heating element retainer (not shown) typically is provided to secure the heating element in the cavity of the tub 6.

SUMMARY

In the assembly of a conventional washer, a heating element retainer generally may be inserted into an opening formed in the tub of the washer. The heating element retainer typically may be configured to retain the heating element in a secure manner in the cavity.

FIGS. 3A to 3E show an exemplary assembly process of a conventional heating element retainer and heating element. In order to secure the heating element 26, some conventional heating element retainers 36 may have a plate 38 that is perpendicular to the longitudinal extent of the heating element 26. In some conventional retainers 36, the plate 38 may have a complex design of a hole 42, which may be, for example, a notch, slot, groove, etc., that receives the heating element 26 as the heating element 26 is inserted in a direction parallel to the longitudinal extent of the heating element 26. In some conventional retainers 36, the plate 38 may be retained in the hole 42 by frictional forces between the surfaces of the hole 42 in the plate 38 and surfaces of the heating element 26. In some other conventional retainers 36, the plate 38 may have a complex design of tabs or spring pieces formed in the hole 42 to press against the heating element 26.

In the conventional heating element retainer 36, the plate 38 typically may be located near the middle of the retainer 36 along a longitudinal extent of the retainer 36. Accordingly, when the heating element 26 is completely assembled in the retainer 36, the plate 38 typically may retain the heating element 26 near a middle portion of the heating element 26 with respect to a longitudinal extent of the heating element 26, as shown in FIG. 3E.

An exemplary assembly process of the conventional heating element retainer 36 and heating element 26 will now be described with reference to FIGS. 3A to 3E.

As shown in FIGS. 3A and 3B, when the heating element 26 is inserted into the cavity 40 of the tub 6, a first end of the heating element 26 typically may reach the plate 38 of the retainer 36 before the base 24 of the heating element 26 can be aligned in the cavity 40. Therefore, the heating element 26 may need to be aligned with the hole 42 by the installer before the base 24 of the heating element 26 can be aligned in the cavity 40. As shown in FIGS. 3A and 3B, the installer may have limited or no visibility with respect to the location of the hole 42 in the plate 38, which is inside the cavity 40 of the tub 6. Hence, the first end of the heating element 26 typically may contact the surface of the plate 38 of the retainer 36, as shown in FIGS. 3A and 3B, instead of passing through the hole 42. In this case, the installer may need to make several attempts to align the heating element 26 with the hole 42 in the plate 38 until the heating element 26 is successfully installed in the hole 42, which may increase the time and effort to install the heating element 26.

Next, as shown in FIG. 3C, when the heating element 26 is inserted into the hole 42 in the plate 38, a force $F_0$ may be applied to the heating element 26 by the plate 38, which may cause the heating element 26 to be tilted or rotated in a plane that it not perpendicular to the plate 38. Accordingly, the heating element 26 may be misaligned during insertion into the cavity 40 of the tub 6, which may cause the base 24 of the heating element 26 to catch on or be interfered with by a top of the cavity 40 on the tub 6, as shown in FIG. 3C. Therefore, in the conventional systems, the base 24 of the heating element 26 may need to be manually aligned with the cavity 40 using an installation tool 50, as shown in FIGS. 3C and 3D. The installer may then need to apply a force $F_1$ to the tool 50 to push the base 24 of the heating element 26 into the cavity 40, as shown in FIGS. 3C to 3E.

Moreover, as shown in FIGS. 3C to 3E, in most conventional systems, a large portion of the heating element 26 may need to be pushed through the hole 42 in the plate 38 of the retainer 36, since the plate 38 may be in the middle of the retainer 36 with respect to the longitudinal extent of the retainer 36. Thus, the installer may need to apply a large amount of force $F_1$ to the tool 50 to push the heating element 26 through the hole 42 until the heating element 26 is completely assembled in the retainer 36, as shown in FIG. 3E.

Furthermore, in conventional washers, a different heating element retainer typically may need to be used for European design washers and U.S. design washers.

In comparison to the conventional retainers, the exemplary aspects of the invention may retain the heating element near a first end of the heating element, thereby reducing or preventing misalignment during the assembly of the heating element into the cavity of the tub. Thus, the heating element retainer according to the invention may be more easily installed as compared to the conventional retainers. The heating element retainer according to the invention also may minimize or reduce the time and effort to install the heating element in the heating element retainer.

Moreover, the exemplary aspects of the invention may reduce an amount of linear translation of the heating element into the engaging portion of the heating element retainer. Further, the exemplary aspects of the invention may reduce an amount of force needed to insert or push the heating element into the heating element retainer.

Additionally, the exemplary aspects of the invention also may provide greater flexibility for accommodate heating elements of different sizes. Thus, the exemplary aspects of the invention also may be universal, for example, to both European designs and U.S. designs.

The exemplary aspects of the invention also may reduce a complexity of the heating element retainer and reduce an amount of material that may be needed to form the heating element retainer, which may reduce manufacturing costs of the heating element retainer.

For example, an exemplary embodiment is directed to a washer including a housing, a tub in the housing, a laundry drum rotatably mounted in the tub, a heating element in the tub, and a heating element retainer, on an inner surface of the tub, for retaining the heating element. The heating element retainer includes a first longitudinal end and a second longitudinal end. The heating element further includes an engaging portion that is formed closer to the second longitudinal end than to the first longitudinal end, and that retains a first end of the heating element.

Another exemplary embodiment is directed to an apparatus including a tub, a heating element in the tub, and a heating element retainer, on an inner surface of the tub, for retaining the heating element. The heating element retainer includes a first longitudinal end and a second longitudinal end, and an engaging portion that is formed closer to the second longitudinal end than to the first longitudinal end, and that retains a first end of the heating element.

Another exemplary embodiment is directed to a heating element retainer for a washer having a housing, a tub in the housing, a laundry drum rotatably mounted in the tub, and a heating element in the tub. The heating element retainer includes a first longitudinal end and a second longitudinal end, and an engaging portion that is formed closer to the second longitudinal end than to the first longitudinal end, and that retains a first end of the heating element.

The features of the invention, however, together with additional objects and advantages thereof will be best understood from the following description of exemplary embodiments when read in connection with the accompanying drawings.

BRIEF DESCRIPTION OF THE DRAWINGS

The accompanying drawings are presented to aid in the description of embodiments of the invention and are provided solely for illustration of the embodiments and not limitation thereof.

DETAILED DESCRIPTION

Figure 1:
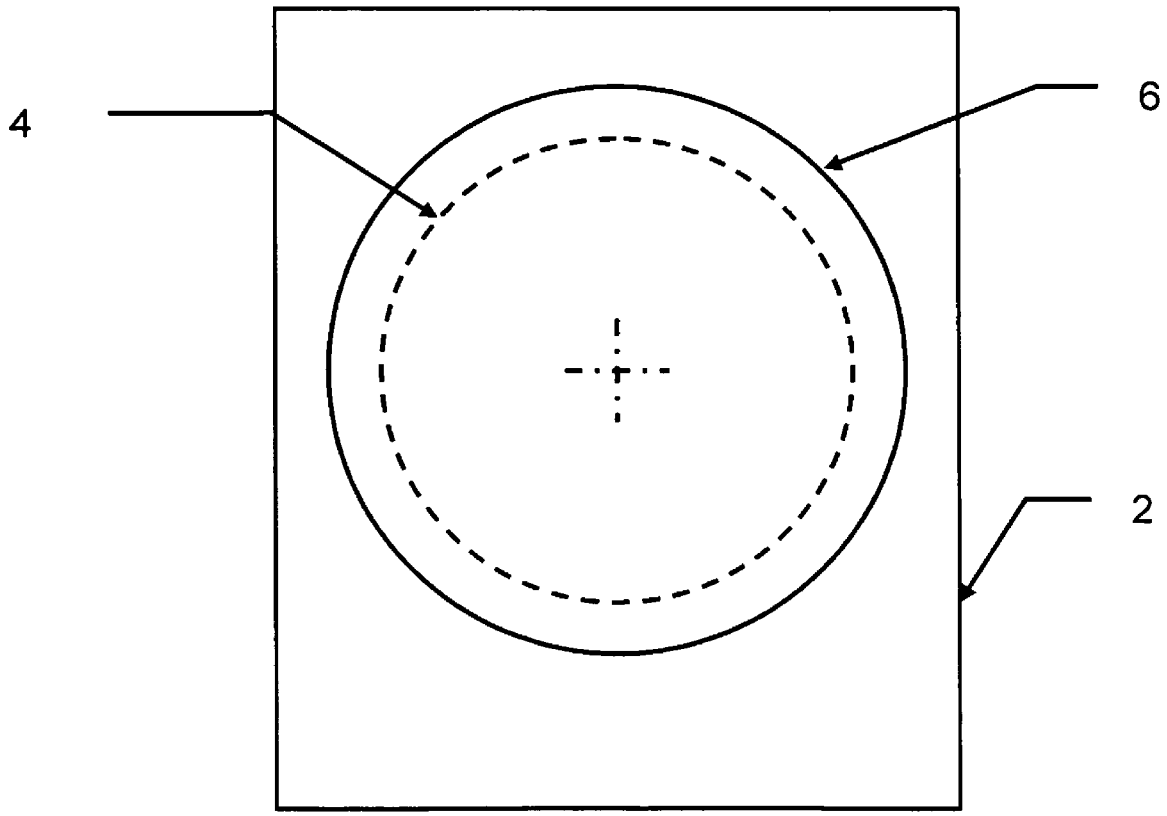
FIGURE 1 Conventional Art
FIG. 1 is a schematic view of a conventional washer.
Figure 2:
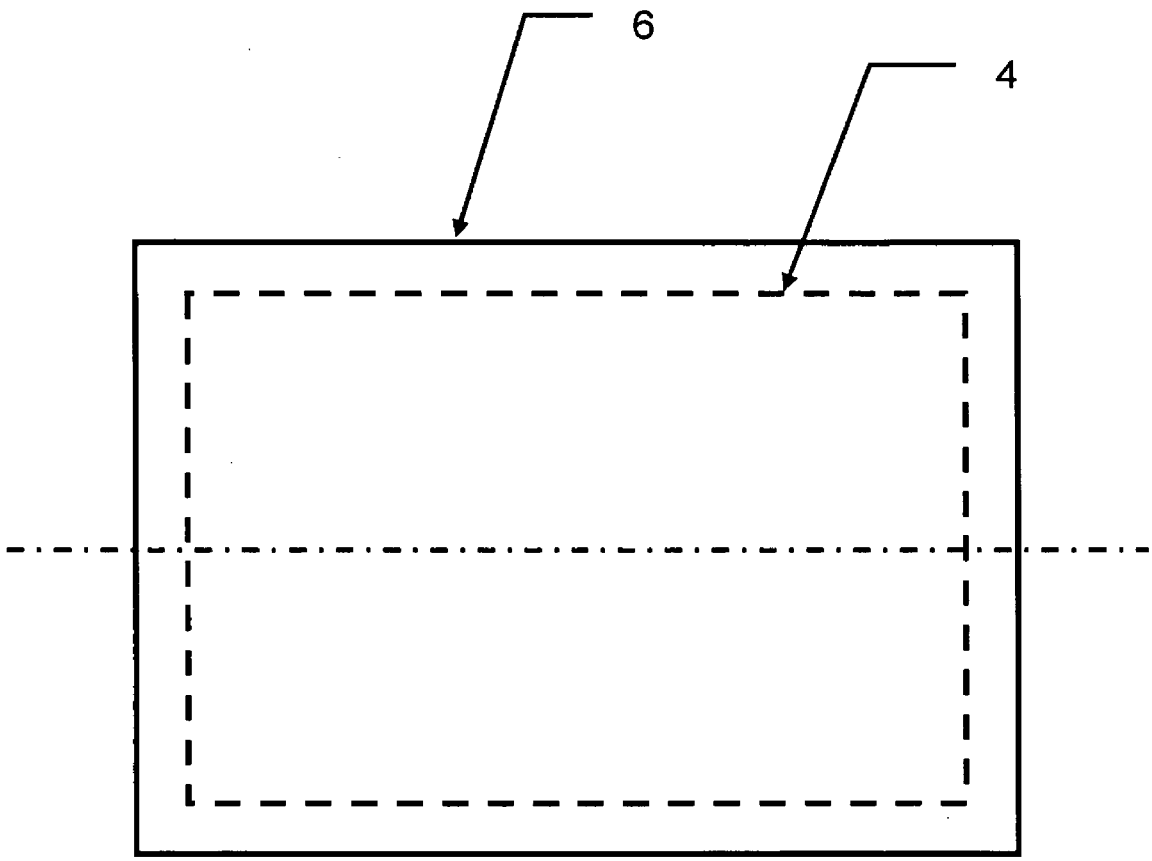
FIGURE 2 Conventional Art
FIG. 2 is a schematic side view of a conventional washer.
Figure 3A:
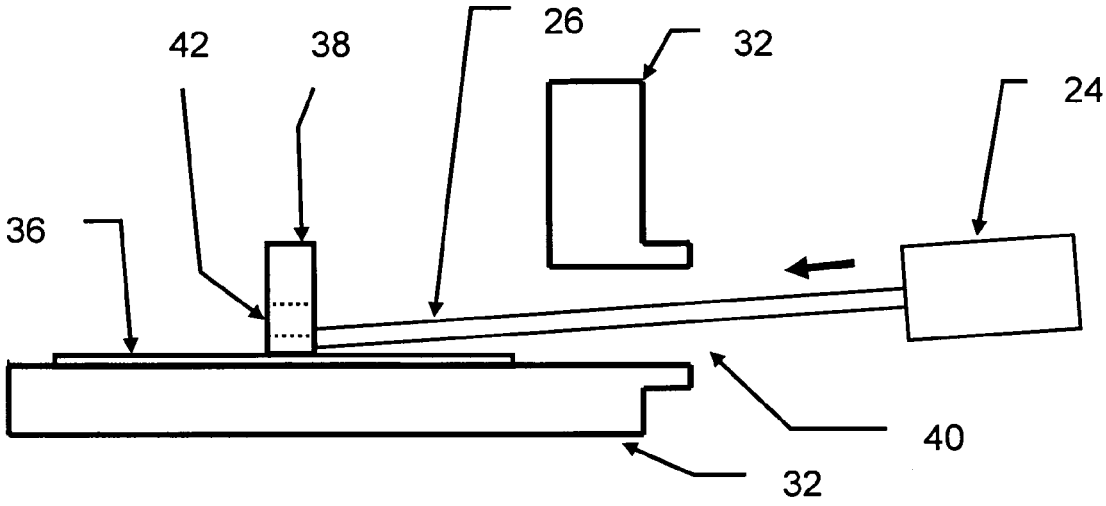
FIGURE 3A Conventional Art
FIGS. 3A to 3E are schematic side views of an assembly process of a conventional heating element retainer and heating element.
Figure 3B:
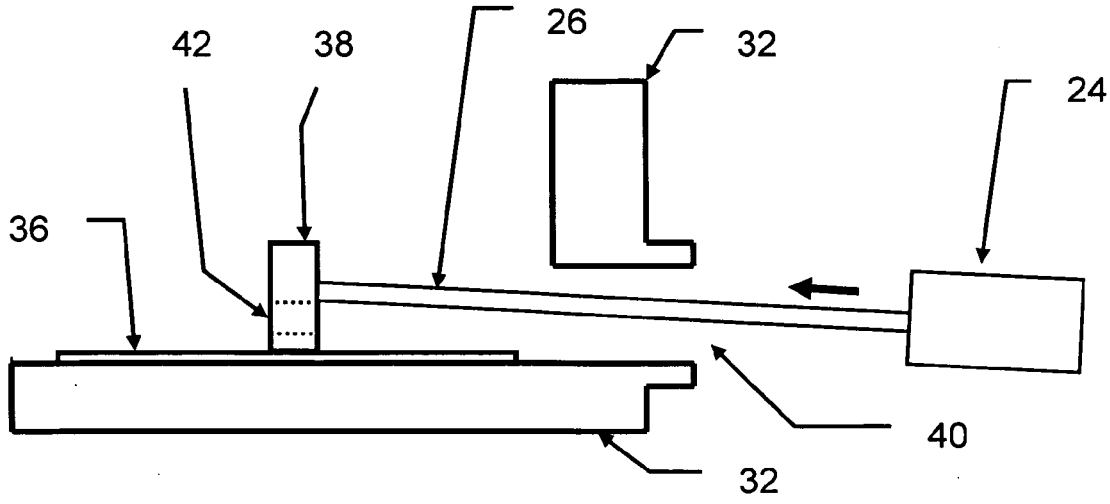
FIGURE 3B Conventional Art
Figure 3C:
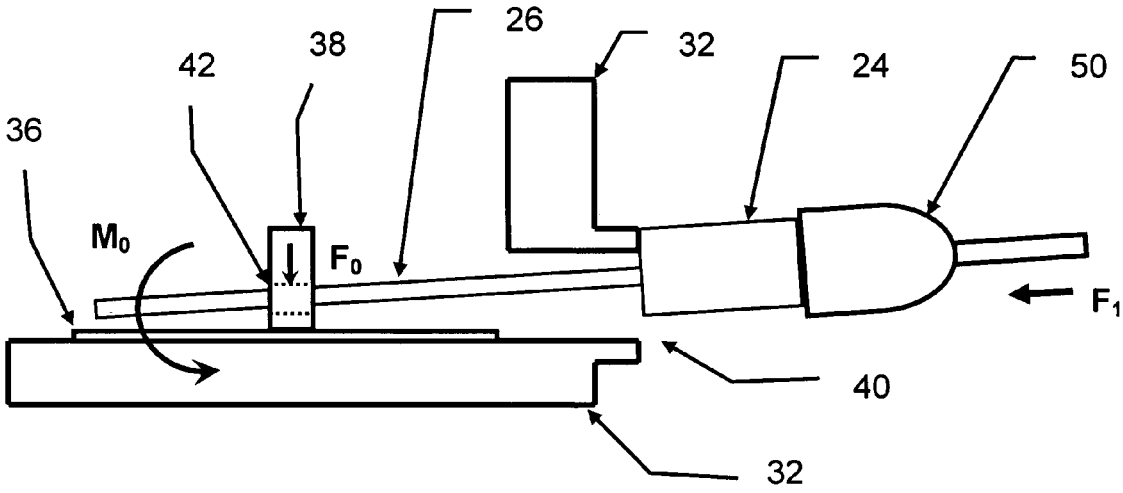
FIGURE 3C Conventional Art
Figure 3D:
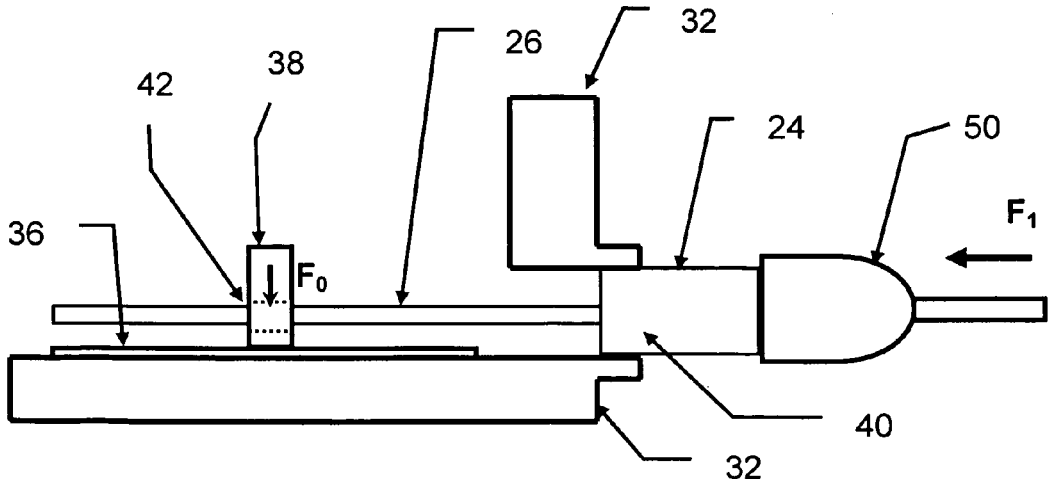
FIGURE 3D Conventional Art
Figure 3E:
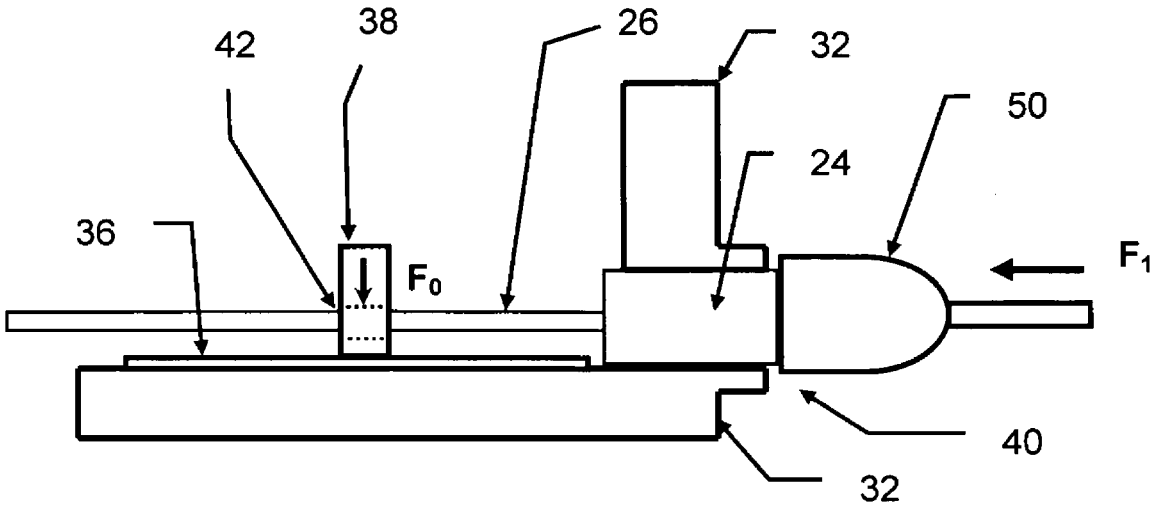
FIGURE 3E Conventional Art

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

With reference to FIGS. 1-11, exemplary embodiments of the invention will now be described.

A heating element retainer 10 according to an embodiment of the invention may have a first longitudinal end 14 and a second longitudinal end 34. The heating element retainer 10 may include an engaging portion, which may be positioned to be closer to the second longitudinal end 34 than to the first longitudinal end 14, for receiving and securing a first end of the heating element 26 in the cavity 40 of the tub 6.

For example, in the embodiment shown in FIGS. 4-7, the retainer 10 may be formed such that a pressing portion 8A is opposed to a supporting surface 16, thereby forming the engaging portion that receives and secures the first end of the heating element 26. One of ordinary skill in the art will recognize that the engaging portion may be formed by other elements, such as one or more crimping elements, pressing elements, supporting surfaces, etc.

As shown in FIGS. 4-7, the longitudinal end 34 may have a closed-end formed by folding the retainer 10 to form the pressing portion 8A. However, the longitudinal end 34 may be open-ended in other exemplary embodiments.

In the exemplary embodiment shown in FIGS. 4-7, the heating element retainer 10 also may have a first guide surface 12A, a second guide surface 12B, and a third guide surface 12C for guiding the heating element 26 into the cavity 40 of the tub 6 and between the opposed pressing portion 8A and supporting surface 16. The retainer 10 also may include a fourth guide surface 8B formed on the pressing portion 8A for guiding the first end of the heating element 26 between the pressing portion 8A and the supporting surface 16.

Figure 4:
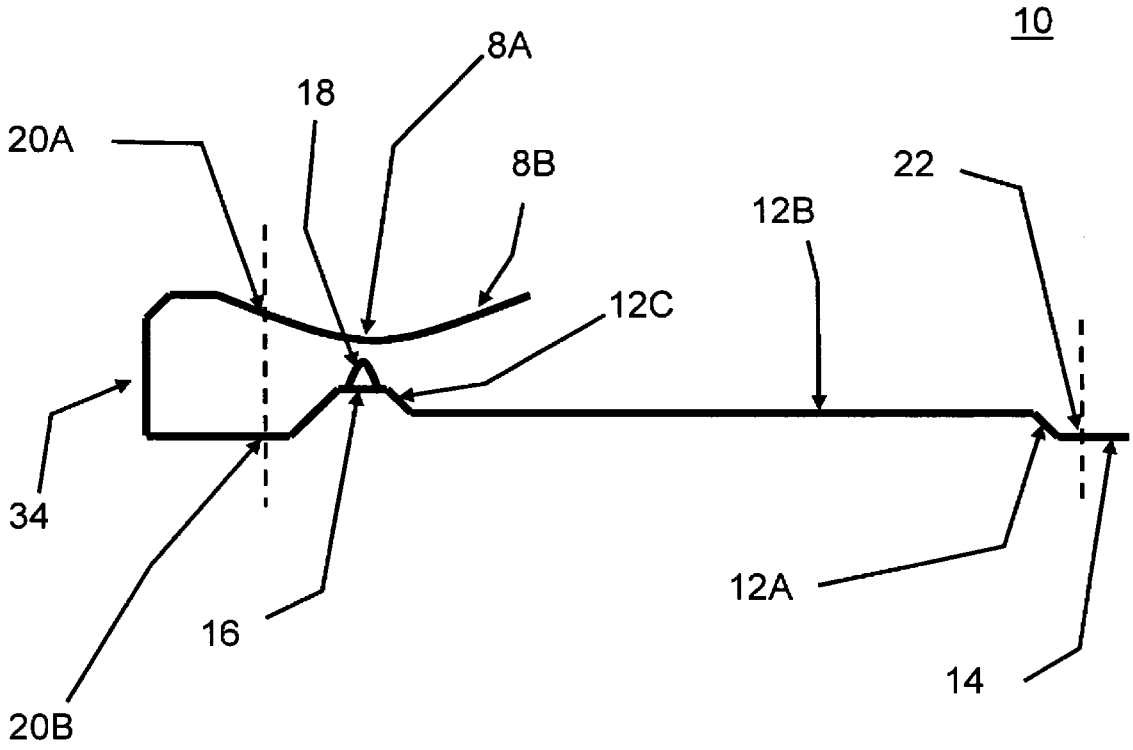
FIG. 4 is a schematic side view of a heating element retainer according to an embodiment of the invention.
Figure 5:
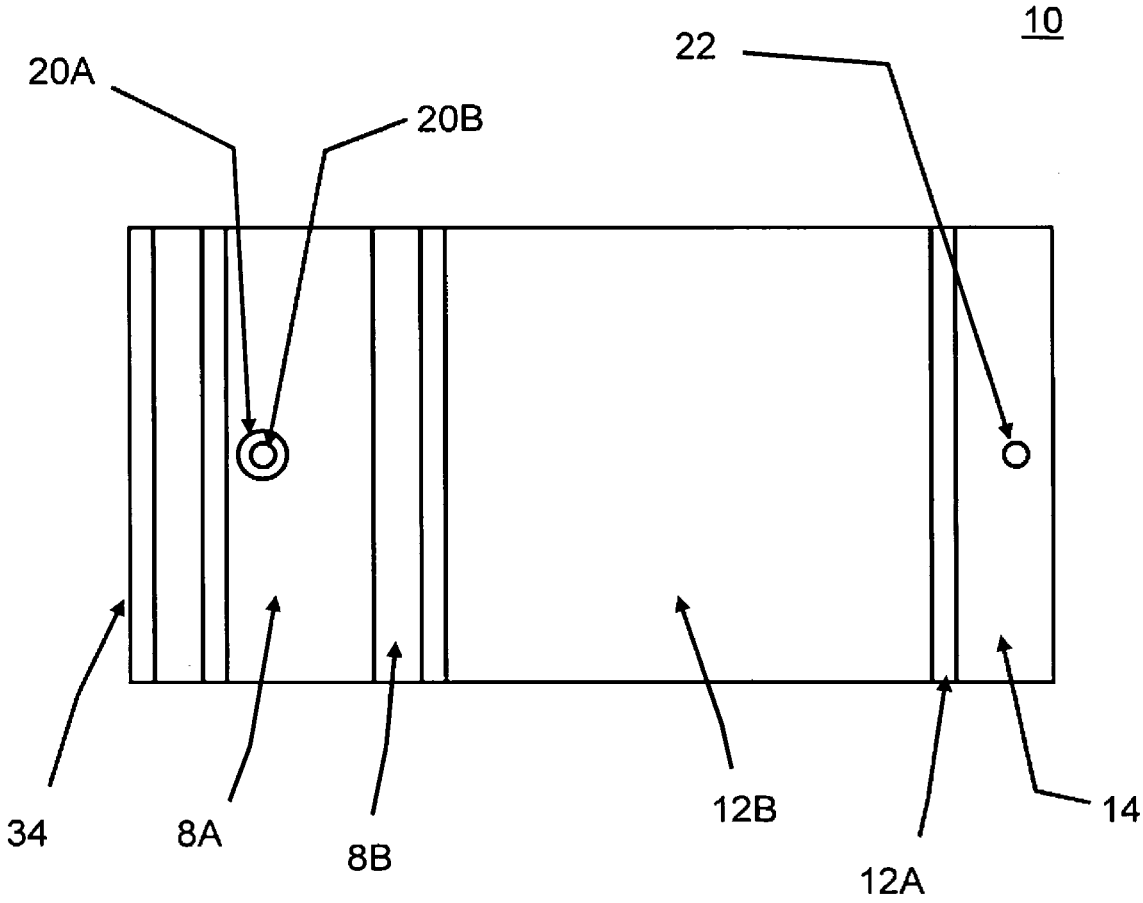
FIG. 5 is a schematic top view of a heating element retainer according to an embodiment of the invention.
Figure 6:
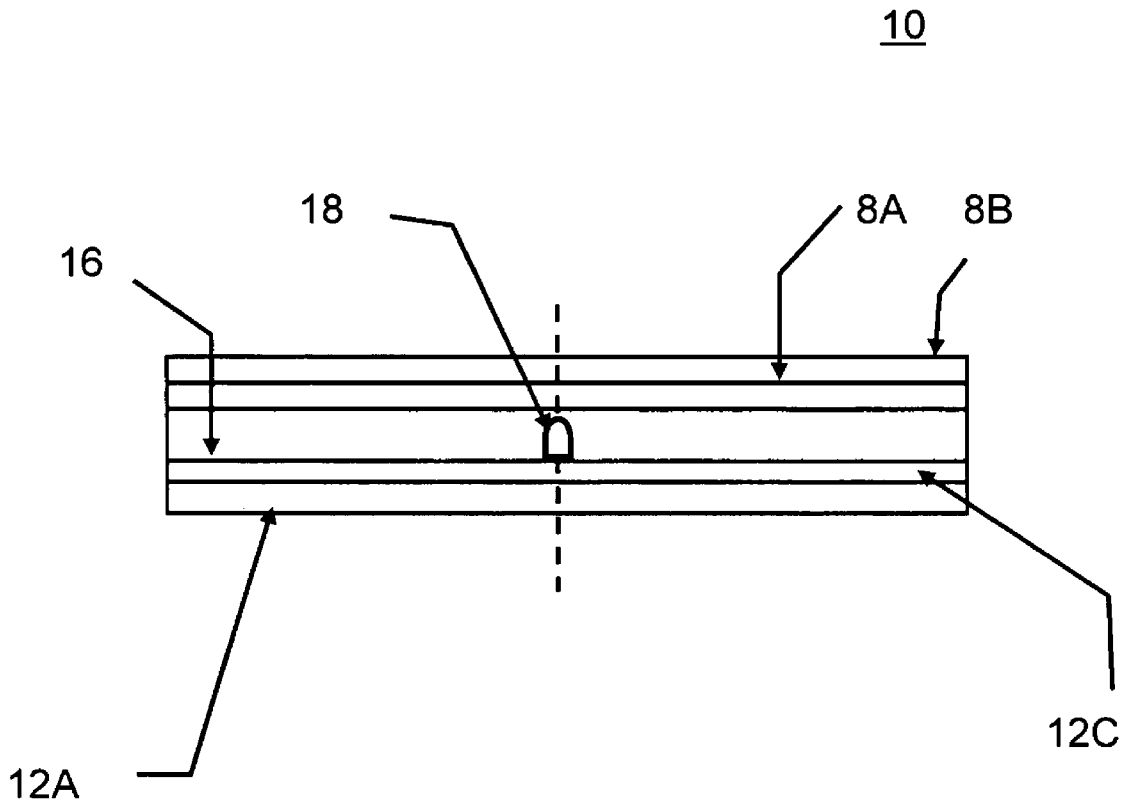
FIG. 6 is a schematic front view of a heating element retainer according to an embodiment of the invention.
Figure 7:
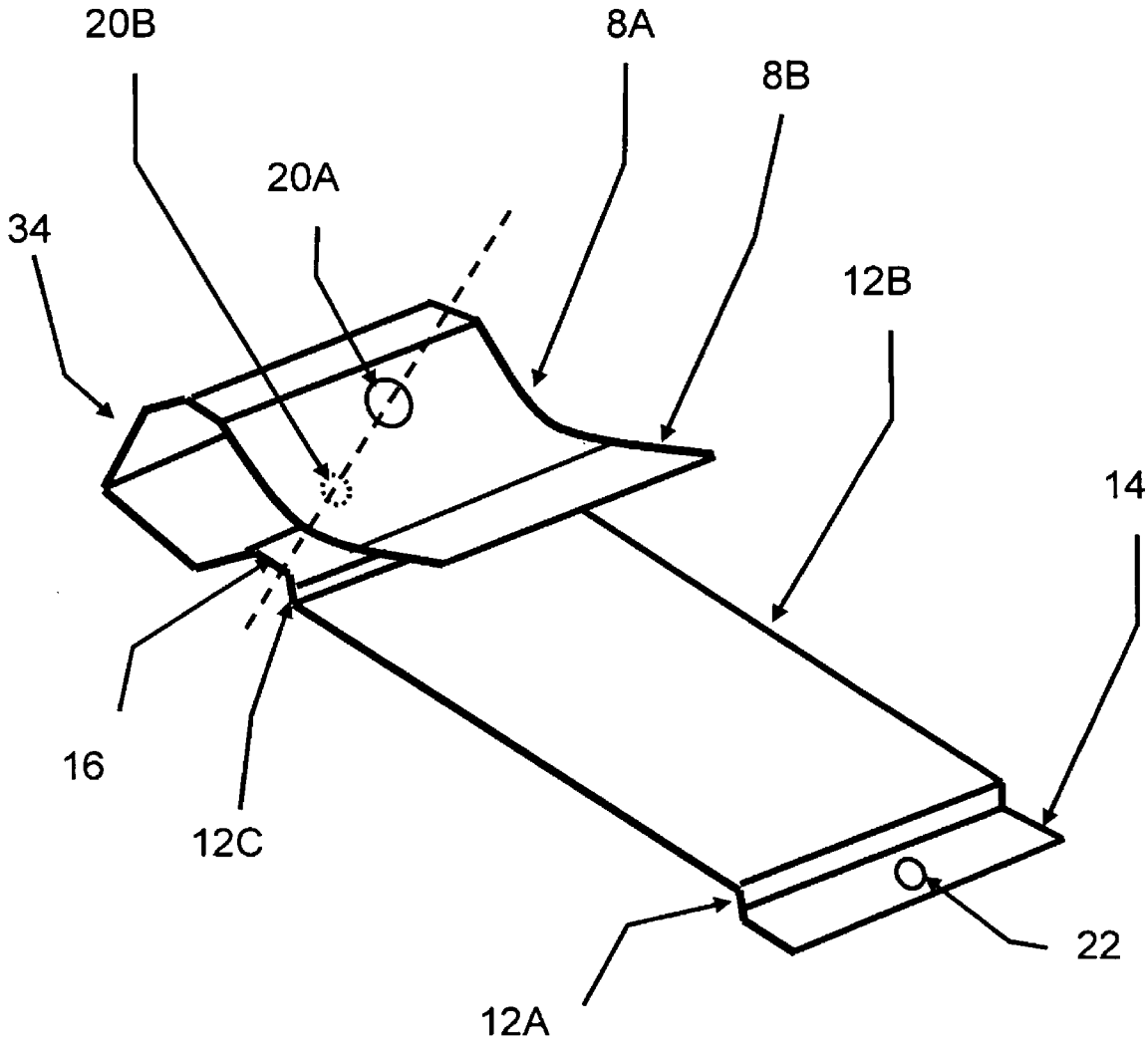
FIG. 7 is a schematic perspective view of a heating element retainer according to an embodiment of the invention.

As shown in FIG. 4, the supporting surface 16 of the retainer 10 also may have a guide element, such as a bump or protrusion 18, which may be used to guide the heating element 26 into the retainer 10. For example, the protrusion 18 may be configured to fit between parts of the heating element 26 to guide the heating element 26 into the retainer 10, as described below with respect to FIG. 9.

The retainer 10 also may include holes 20A, 20B, and 22 for mounting the retainer 10 to the wall 32 of the cavity 40. The hole 20A may have a diameter that is larger than a diameter of a fastener, such as a screw 70, such that the screw 70 may be inserted through the hole 20A and into the hole 20B during the assembly process. The holes 20B and 22 may have diameters that are smaller that the diameter of the screw 70.

According to an embodiment of the invention, the heating element retainer 10 may be on (e.g., mounted on) the wall 32 of the cavity 40 of the tub 6. For example, the first longitudinal end 14 and the second longitudinal end 34 of the retainer 10 may contact the wall 32 of the tub 6. In the embodiment, the heating element retainer 10 may be fixedly attached to the wall 32 using screws 70, which extend through holes 20B and 22 into the wall 32.

An exemplary embodiment of an assembly of a heating element 26 and a heating element retainer 10, will now be described with reference to FIGS. 8A-8D and 9.

Figure 8A:
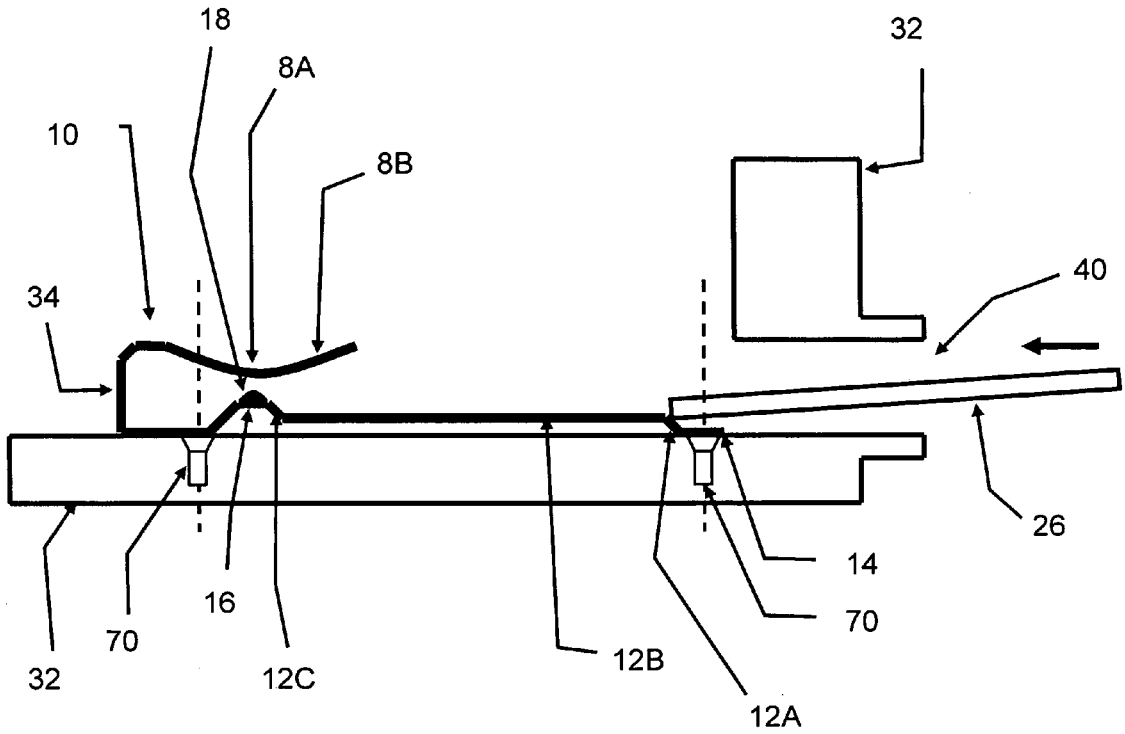
FIGS. 8A to 8D are schematic side views of an assembly process of a heating element and heating element retainer according to an embodiment of the invention.
Figure 8B:
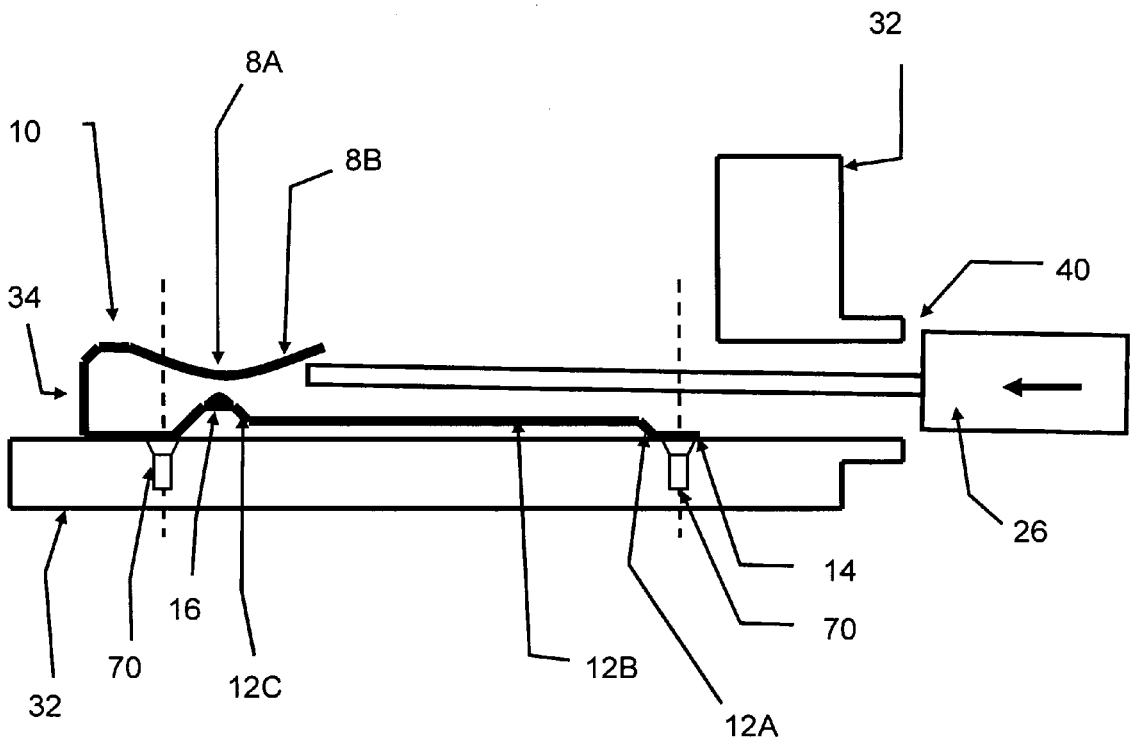
Figure 8C:
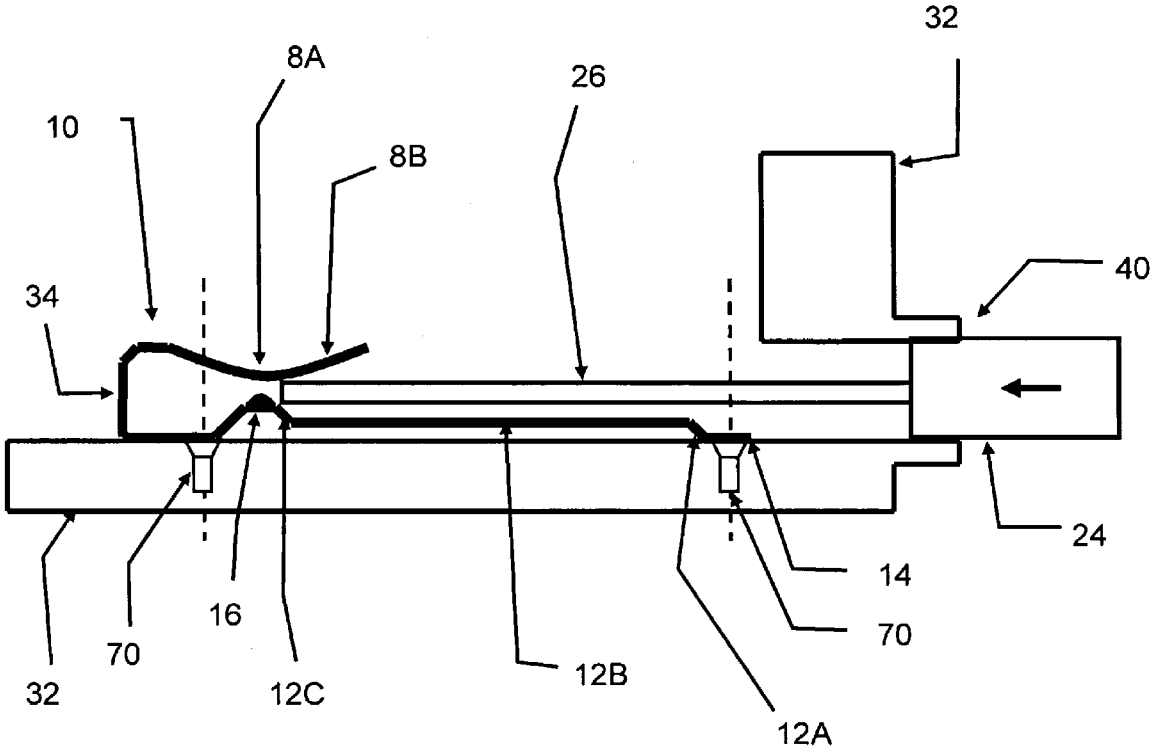
Figure 8D:
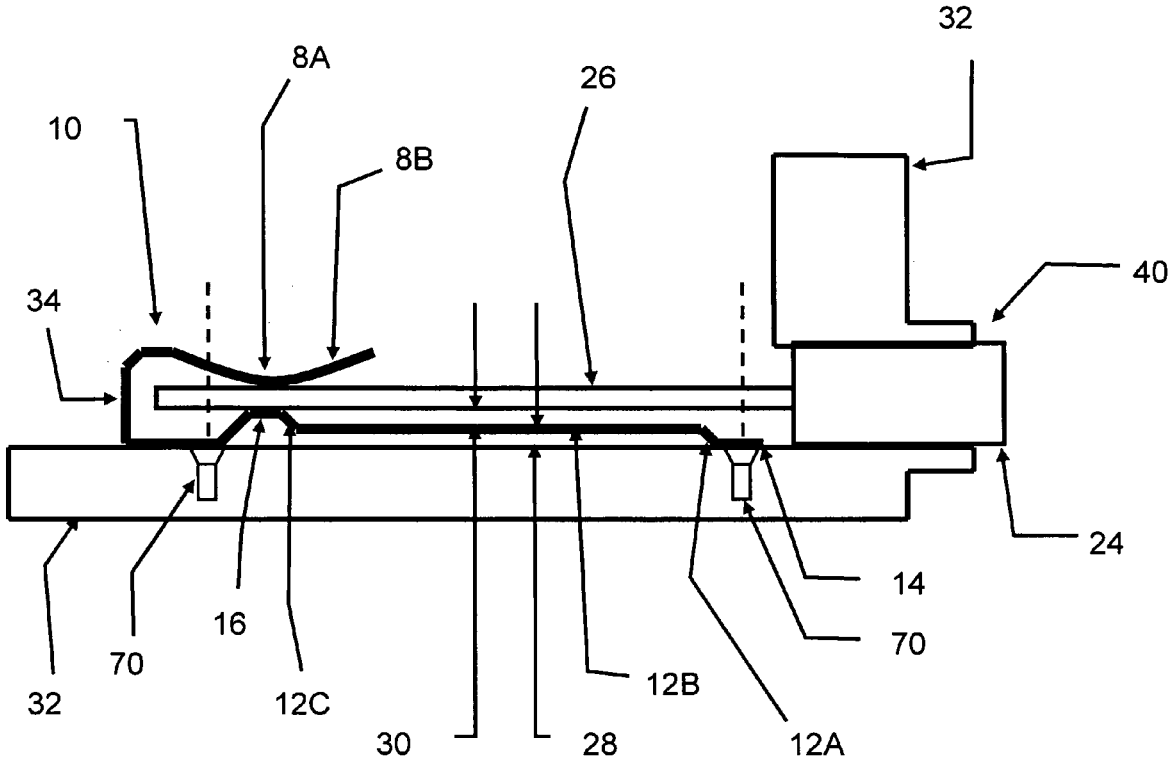
Figure 9:
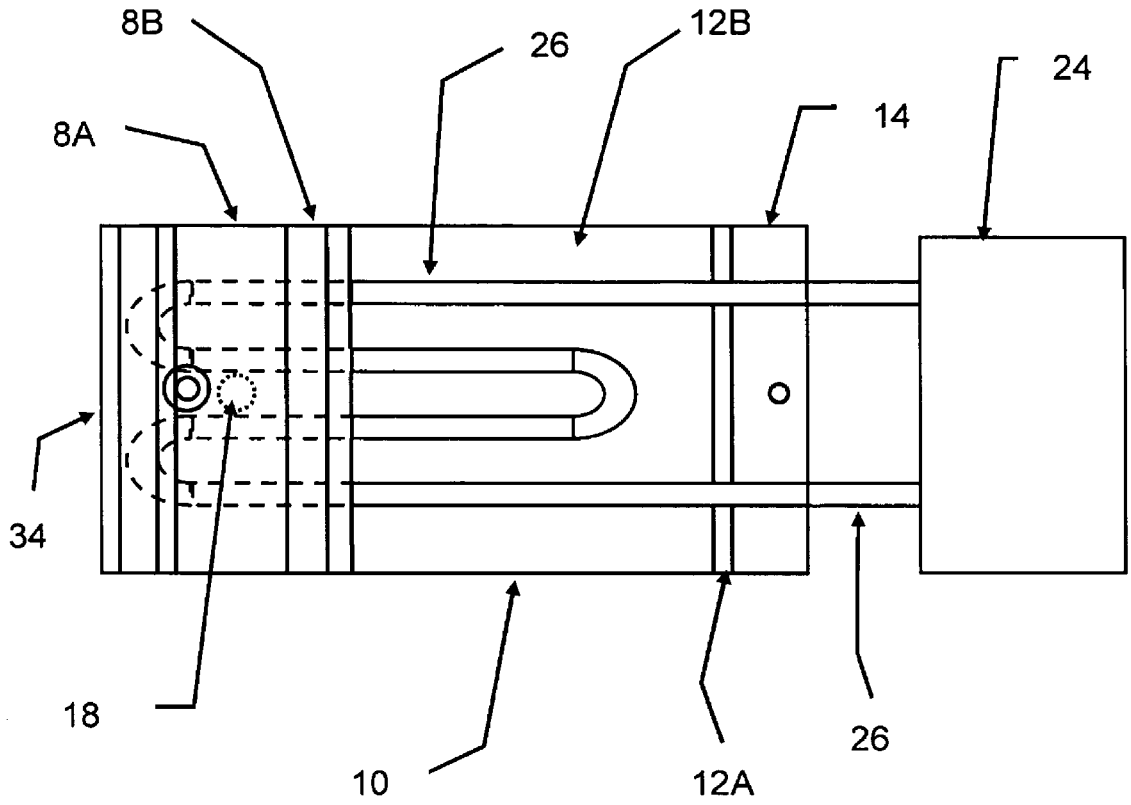
FIG. 9 is a schematic top view of an assembly of a heating element and heating element retainer according to an embodiment of the invention.

As shown, for example, in FIGS. 8D and 9, a heating element 26 may have a base 24. The base 24 may have a seal, or be received by a seal disposed in the cavity 40 formed in the wall 32, to hermetically seal the heating element 26 in the cavity 40 of the tub 6. One of ordinary skill in the art will recognize that other configurations of a heating element 26 may be used within the spirit and scope of the invention.

In an embodiment of the invention, the pressing portion 8A and the supporting surface 16 of the second longitudinal end 34 of the retainer 10 may cooperate to receive a first end of the heating element 26. When the first end of the heating element 26 is inserted between the pressing portion 8A and the supporting surface 16, the pressing portion 8A may apply pressure on the first end of the heating element 26 to secure the heating element 26 in place.

As shown, for example, in FIGS. 8D and 9, only the first end of the heating element 26 is inserted between the pressing portion 8A and the supporting surface 16 of the heating element retainer 10, according to the embodiment of the invention. Accordingly, the exemplary aspects of the invention may reduce an amount of linear translation of the heating element 26 between the pressing portion 8A and the supporting surface 16 of the retainer 10. Further, the exemplary aspects of the invention may reduce an amount of force needed to push the heating element 26 into the heating element retainer 10. Moreover, the exemplary aspects of the invention also may provide greater flexibility, for example, since the pressing portion 8A of the retainer 10 may flex to accommodate heating elements 26 of different sizes. Thus, the exemplary aspects of the invention also may be universal to both European designs and U.S. designs.

An exemplary assembly process of a heating element 26 and a heating element retainer 10, according to the exemplary embodiments of the invention, will now be described with reference again to FIGS. 8A-8D and 9.

As shown in FIG. 8A, the cavity 40 is formed in the wall 32 of the tub 6. The heating element retainer 10 is mounted within the cavity 40 and on the wall 32 of the tub 6. When the heating element 26 is inserted into the cavity 40, the first guide surface 12A may guide the first end of the heating element 26 onto the second guide surface 12B.

As shown in FIG. 8B, the heating element 26 may be pushed further into the cavity 40 along the guide surface 12B. During the installation, if the first end of the heating element 26 is tilted downward, then the third guide surface 12C may guide or funnel the first end of the heating element 26 toward the pressing portion 8A and the supporting surface 16. On the other hand, if the first end of the heating element 26 is tilted upward, then the fourth guide surface 8B may guide or funnel the first end of the heating element 26 toward the pressing portion 8A and the supporting surface 16.

As shown in FIGS. 8B and 8C, the third guide surface 12C and the fourth guide surface 8B also may help to align the base 24 of the heating element 26 with the cavity 40. As the heating element 26 is inserted further into the tub 6, the base 24 is aligned and inserted into the cavity 40. As shown in FIG. 8C, since only the first end of the heating element 26 may need to be pushed into the retainer 10, the base 24 of the heating element 26 may be aligned with the cavity 40 before the heating element 26 is received in the engaging portion of the retainer 10. That is, the heating element 26 may be installed into the cavity 40 of tub 6 up to the base 24 on heating element 26 prior to inserting the first end of the heating element 26 between the pressing portion 8A and the supporting surface 16 of the retainer 10. Therefore, in contrast to the conventional retainers, the embodiment may minimize or avoid any misalignment of the heating element 26 due to pressure being applied on the heating element 26 from the retainer 10. Accordingly, the exemplary aspects of the invention may reduce or prevent misalignment of the heating element 26 in the cavity 40 and simplify the installation process.

When the base 24 of the heating element 26 is aligned with the top of the cavity 40 in the tub 6, the heating element 26 may be pushed into the engaging portion of the retainer 10. For example, as shown in FIG. 8D, the first end of the heating element 26 may be inserted between the pressing portion 8A and the supporting surface 16 of the retainer. As set forth above, the exemplary aspects of the invention may reduce an amount of linear translation of the heating element 26 between the pressing portion 8A and the raised supporting surface 16 of the retainer 10, and also may reduce an amount of force needed to push the heating element 26 into the heating element retainer 10.

As shown in FIG. 9, the raised supporting surface 16 of the retainer 10 also may have a guide element, such as a bump or protrusion 18, which may further guide the heating element 26 into the retainer 10. The protrusion 18 may be configured to fit between parts of the heating element 26 to guide the heating element 26 between the pressing portion 8A and the supporting surface 16. For example, in the exemplary embodiment shown in FIG. 9, the heating element 26 may have a plurality of U-shaped parts. In this embodiment, the heating element 26 may be inserted between the pressing portion 8A and the supporting surface 16 such that the protrusion 18 interposes adjacent U-shaped parts of the heating element 26, thereby guiding the heating element 26 between the pressing portion 8A and the supporting surface 16 of the retainer 10.

Accordingly, the exemplary aspects of the invention may reduce or prevent misalignment of the heating element 26 in the cavity 40 and simplify the installation process.

As shown, for example, in FIG. 8D, the second guide surface 12B of the retainer 10 may be formed such that a first gap 28 is formed between the second guide surface 12B of the retainer 10 and the wall 32 of the tub 6 of the washer 2. The second guide surface 12B of the retainer 10 also may be formed such that a second gap 30 is formed between the second guide surface 12B and the heating element 26. In this embodiment, the second guide surface 12B of the retainer 10 may form, for example, a heat shield that may protect the wall 32 of the tub 6 from excessive heat from the heating element 26.

The aspects of the invention are not limited to the exemplary embodiments described above. For example, a heating element retainer 10 according to another embodiment of the invention is illustrated in FIGS. 10 and 11.

Figure 10:
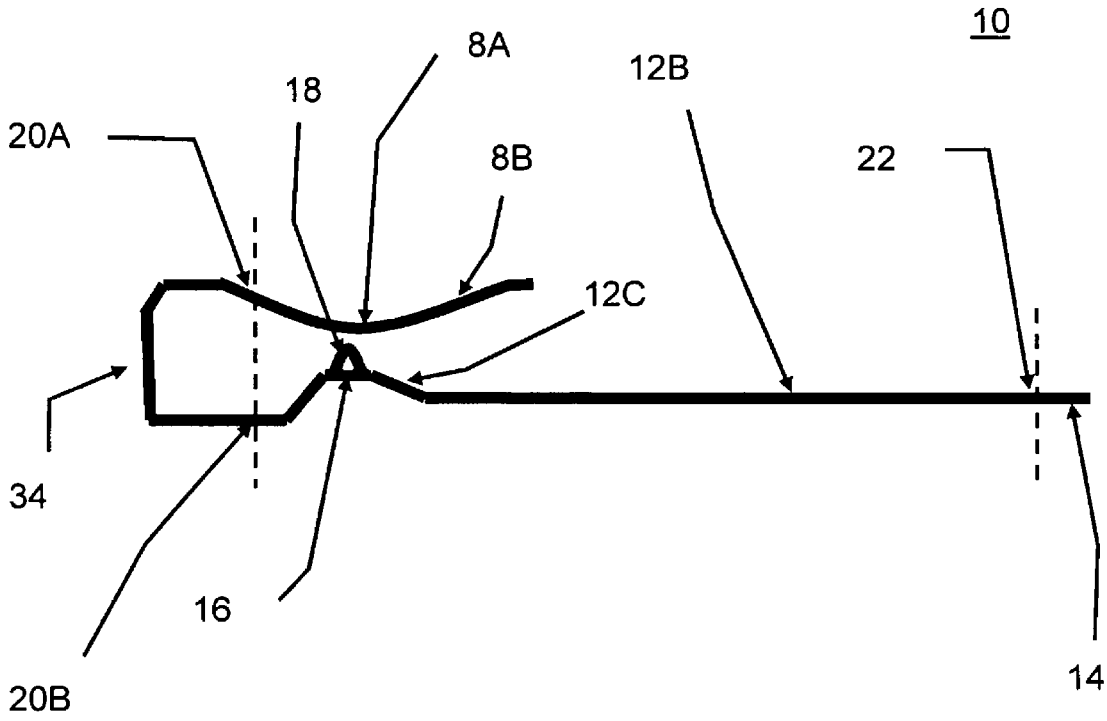
FIG. 10 is a schematic side view of a heating element retainer according to an embodiment of the invention.
Figure 11:
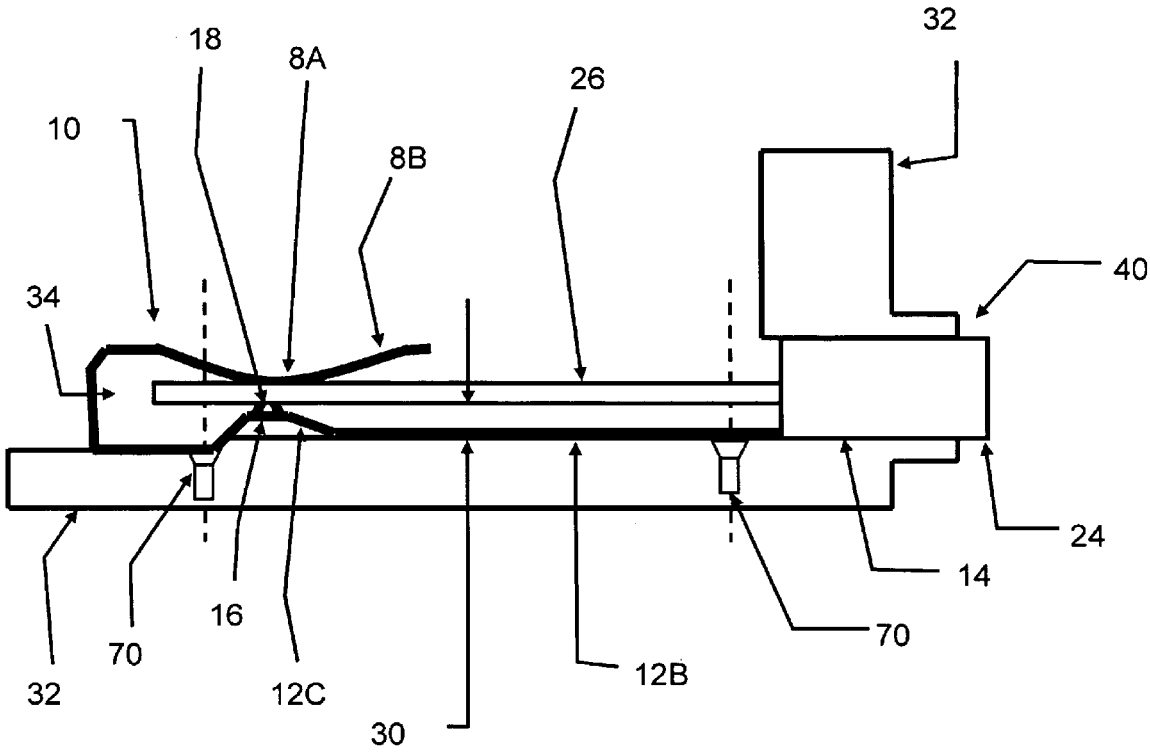
FIG. 11 is a schematic side view of an assembly of a heating element and heating element retainer according to an embodiment of the invention.

As shown in FIGS. 10 and 11, a heating element retainer 10 according to another embodiment of the invention may be formed such that second guide surface 12B of the retainer 10 abuts directly against the wall 32 of the tub 6. Accordingly, in this embodiment, there is substantially no gap formed between the retainer 10 and the wall 32 of the tub 6.

Referring again to the embodiment of FIGS. 10 and 11, the second guide surface 12B may extend from the first longitudinal end 14 to the third guide surface 12C. Thus, the first end of the heating element 26 may be guided by the second guide surface 12B to the engaging portion of the retainer 10.

Accordingly, the exemplary aspects of the invention may reduce a complexity of the heating element retainer and reduce an amount of material that may be needed to form the heating element retainer. Further, the exemplary aspects may reduce manufacturing costs of the heating element retainer. The exemplary aspects of the invention also may retain the heating element near a first end of the heating element, thereby reducing or preventing misalignment during the assembly of the heating element into the cavity of the tub. Thus, the heating element retainer according to the invention may be more easily installed as compared to the conventional retainers. The exemplary aspects of the invention also may be universal to both European designs and U.S. designs.

While the foregoing disclosure shows illustrative embodiments of the invention with reference to a washer having a heating element retainer, it is nevertheless not intended to be limited to the details shown. For example, another embodiment of the invention is directed to an apparatus having a heating element retainer.

It should be noted that various changes and modifications could be made herein without departing from the scope of the invention as defined by the appended claims and a range of equivalents thereof. Furthermore, although elements of the invention may be described or claimed in the singular, the plural is contemplated unless limitation to the singular is explicitly stated.

What is claimed is:

1. A washer comprising:

a housing;

a tub in the housing;

a laundry drum rotatably mounted in the tub;

a heating element in the tub; and a heating element retainer, on an inner surface of the tub, for retaining the heating element, wherein the heating element retainer includes:

a first longitudinal end and a second longitudinal end;

an engaging portion that is formed closer to the second longitudinal end than to the first longitudinal end, and that retains a first end of the heating element; and a planar surface extending from the first longitudinal end of the heating element retainer to the engaging portion of the heating element retainer, wherein the planar surface guides the first end of the heating element to the engaging portion in a longitudinal direction travelling from the first longitudinal end to the second longitudinal end of the heating element retainer.

2. The washer according to claim 1, wherein a first end of the heating element extends through an opening in a wall of the tub and a base of the heating element is sealed in the opening in the wall of the tub, wherein the first longitudinal end of the heating element retainer is adjacent to the opening in the wall of the tub, and wherein the engaging portion of the heating element retainer is located a predetermined distance from the opening in the wall of the tub, whereby the base of the heating element is aligned in the opening of the tub prior to the first end of the heating element being retained in the engaging portion.

3. The washer according to claim 2, wherein the heating element comprises:

a heating part having a first longitudinal end and a second longitudinal end; and a base that supports the first longitudinal end of the heating part, wherein the base is sealed in an opening in the wall of the tub, wherein the heating part extends into an interior of the tub and along an inside surface of the wall of the tub, and wherein the first longitudinal end of the heating element retainer is adjacent to the opening in the wall of the tub.

4. The washer according to claim 2, wherein a distance of the engaging portion of the heating element retainer from the opening in the wall of the tub is substantially equal to a length of the heating part of the heating element.

5. The washer according to claim 4, wherein, when the heating element is inserted through the opening in the wall of the tub and into the heating element retainer, the base of the heating element is aligned in the opening in the wall of the tub before the first end of the heating element is retained in the engaging portion of the heating element retainer.

6. The washer according to claim 1, wherein the engaging portion is formed by folding a portion of the heating element retainer onto itself.

7. The washer according to claim 1, wherein the heating element retainer further comprises:

a guide surface that guides the heating element to the engaging portion in a longitudinal direction travelling from the first longitudinal end to the second longitudinal end of the heating element retainer.

8. The washer according to claim 1, wherein the engaging portion comprises:

a supporting surface; and a pressing portion opposed to the supporting surface and cooperating with the supporting surface to retain the first end of the heating element.

9. The heating element retainer according to claim 8, wherein the supporting surface includes a guide for engaging the heating element.

10. The washer according to claim 1, wherein the heating element retainer further comprises:

a guide surface that is adjacent to the first longitudinal end of the heating element retainer, and that guides the first end of the heating element to the planar surface.

11. The washer according to claim 1, wherein a portion of the heating element retainer having the planar surface forms a first gap between the heating element retainer and the inner surface of the tub.

12. The washer according to claim 1, wherein substantially all of a portion of the heating element retainer having the planar surface abuts the inner surface of the tub.

13. The washer according to claim 1, wherein only portions of the first longitudinal end and the second longitudinal end of the heating element retainer abut an inside surface of the tub.

14. A washer comprising:

a housing;

a tub in the housing;

a laundry drum rotatably mounted in the tub;

a heating element in the tub; and a heating element retainer, on an inner surface of the tub, for retaining the heating element, wherein the heating element retainer includes:

a first longitudinal end and a second longitudinal end; and an engaging portion that is formed closer to the second longitudinal end than to the first longitudinal end, and that retains a first end of the heating element, wherein the engaging portion comprises:

a supporting surface; and a pressing portion opposed to the supporting surface and cooperating with the supporting surface to retain the first end of the heating element, and wherein the heating element retainer further comprises:

a planar surface extending from the first longitudinal end of the heating element retainer to the engaging portion of the heating element retainer, wherein the planar surface guides the first end of the heating element to the engaging portion in a longitudinal direction travelling from the first longitudinal end to the second longitudinal end of the heating element retainer.

15. The washer according to claim 14, wherein the heating element retainer further comprises:

a first guide surface that guides the first end of the heating element to the supporting surface; and a second guide surface that guides the first end of the heating element to the pressing portion, wherein the first guide surface is opposed to the second guide surface for funneling the first end of the heating element between the supporting surface and the pressing portion when the heating element is travelling in the longitudinal direction.

16. The washer according to claim 15, wherein the heating element retainer further comprises:

a third guide surface that is adjacent to the first longitudinal end of the heating element retainer, and that guides the first end of the heating element to the planar surface.

17. The washer according to claim 14, wherein a portion of the heating element retainer having the planar surface forms a first gap between the heating element retainer and the tub.

18. The washer according to claim 14, wherein the planar surface forms a second gap between the heating element retainer and the heating element.

19. The washer according to claim 14, wherein substantially all of a portion of the heating element retainer having the planar surface abuts an inside surface of the tub.

20. The washer according to claim 14, wherein only portions of the first longitudinal end and the second longitudinal end of the heating element retainer abut an inside surface of the tub.

21. An apparatus comprising:

a tub;

a heating element in the tub; and a heating element retainer, on an inner surface of the tub, for retaining the heating element, wherein the heating element retainer includes:

a first longitudinal end and a second longitudinal end;

an engaging portion that is formed closer to the second longitudinal end than to the first longitudinal end, and that retains a first end of the heating element; and a planar surface extending from the first longitudinal end of the heating element retainer to the engaging portion of the heating element retainer, wherein the planar surface guides the first end of the heating element to the engaging portion in a longitudinal direction travelling from the first longitudinal end to the second longitudinal end of the heating element retainer.

22. The apparatus according to claim 21, wherein the heating element retainer further comprises:

a guide surface that is adjacent to the first longitudinal end of the heating element retainer, and that guides the first end of the heating element to the planar surface.

23. A heating element retainer for a washer having a housing, a tub in the housing, a laundry drum rotatably mounted in the tub, and a heating element in the tub, the heating element retainer comprising:

a first longitudinal end and a second longitudinal end;

an engaging portion that is formed closer to the second longitudinal end than to the first longitudinal end, and that retains a first end of the heating element; and a planar surface extending from the first longitudinal end of the heating element retainer to the engaging portion of the heating element retainer, wherein the planar surface guides the first end of the heating element to the engaging portion in a longitudinal direction travelling from the first longitudinal end to the second longitudinal end of the heating element retainer.

24. The heating element retainer according to claim 23, wherein the heating element retainer further comprises:

a guide surface that is adjacent to the first longitudinal end of the heating element retainer, and that guides the first end of the heating element to the planar surface.

* * * * *